US010024013B2

(12) United States Patent
Salis

(10) Patent No.: US 10,024,013 B2
(45) Date of Patent: Jul. 17, 2018

(54) FLOATING DAM OR ISLAND AND METHOD OF MANUFACTURE THEREOF

(71) Applicant: Giorgio Salis, Cagliari (IT)

(72) Inventor: Giorgio Salis, Cagliari (IT)

( * ) Notice: Subject to any disclaimer, the term of this patent is extended or adjusted under 35 U.S.C. 154(b) by 0 days.

(21) Appl. No.: 15/517,787

(22) PCT Filed: Oct. 8, 2015

(86) PCT No.: PCT/IB2015/057702
§ 371 (c)(1),
(2) Date: Apr. 7, 2017

(87) PCT Pub. No.: WO2016/055965
PCT Pub. Date: Apr. 14, 2016

(65) Prior Publication Data

US 2017/0306579 A1 Oct. 26, 2017

(30) Foreign Application Priority Data

Oct. 8, 2014 (IT) ..... TO2014A0801

(51) Int. Cl.
*E02B 3/06* (2006.01)
*B63B 5/14* (2006.01)
(Continued)

(52) U.S. Cl.
CPC ..... *E02B 3/062* (2013.01); *B63B 5/14* (2013.01); *B63B 35/38* (2013.01); *B63B 35/44* (2013.01);
(Continued)

(58) Field of Classification Search
USPC ..... 405/195.1, 205
See application file for complete search history.

(56) References Cited

U.S. PATENT DOCUMENTS 3,675,606 A * 7/1972 Takezawa ..... B63B 9/00 114/65 R
4,479,450 A 10/1984 Lundberg
(Continued)

FOREIGN PATENT DOCUMENTS

EP 0905324 A1 3/1999
IT TO20120216 A1 9/2013

OTHER PUBLICATIONS

Patent Cooperation Treaty, Notification of Transmittal of the International Search Report and the Written Opinion of the ntemational Searching Authority, or the Declaration for PCT/162015/057702 dated Dec. 2, 2015, 12 pages.

*Primary Examiner* — Kyle Armstrong
(74) *Attorney, Agent, or Firm* — Heslin Rothenberg Farley & Mesiti P.C.; Victor A. Cardona, Esq.

(57) ABSTRACT

A floating dam or island is provided by pre-fabricating modular hollow bodies. A first group of modular bodies is laid floating on a water surface, positioning the modular bodies in mutual side-to-side arrangement so as to delimit therebetween intermediate gaps within which the reinforcing rods are protruding. A first concrete casting is performed into the gaps and over the modular bodies so as to render them mutually joined. A second group of modular bodies is then laid over the first group and a second concrete casting is performed in order to join the first and second group together. Additional groups of modular bodies are laid and further concrete castings are performed up to obtaining a monolithic block having a desired floating dam or island configuration.

20 Claims, 9 Drawing Sheets

(51) Int. Cl.
*B63B 35/38* (2006.01)
*B63B 35/44* (2006.01)

(52) U.S. Cl.
CPC ..... *B63B 2035/4433* (2013.01); *E02B 3/064* (2013.01)

(56) References Cited

U.S. PATENT DOCUMENTS

| | | | | |
|---|---|---|---|---|
| 5,379,559 | A * | 1/1995 | Niimura | B63B 21/50 405/205 |
| 5,740,753 | A | 4/1998 | Theophanis | |
| 6,058,869 | A | 5/2000 | Thon | |
| 6,860,219 | B1 * | 3/2005 | Dempster | B63B 21/22 114/264 |

* cited by examiner

FLOATING DAM OR ISLAND AND METHOD OF MANUFACTURE THEREOF

CROSS REFERENCE TO RELATED APPLICATIONS

This application is a National Stage filing under section 371 of International Application No. PCT/IB2015/057702, filed on Oct. 8, 2015, and published on Apr. 14, 2016, as WO 2016/055965 A1 and claims priority to Italian Application No. TO2014A000801, filed on Oct. 8, 2014. The entire disclosures of each of the prior applications are hereby incorporated herein by reference.

FIELD OF THE INVENTION

The present invention generally refers to floating installations and more particularly regards a breakwater dam, designed to defend and protect ports or shores against water waves. In addition, it also regards a floating island provided for creating landing space as well as possible residential settlements.

STATE OF THE ART

Breakwater dams traditionally consist of permanent installations manufactured using conventional construction techniques.

Manufacturing floating structures formed by hollow bodies, even made of plastic material, interconnected to each other and provided with systems for anchoring to the floor, was proposed—to replace fixed installations—solely as regards piers and wharfs. Examples of floating wharfs thus made are described and illustrated, for example, in the European patent EP-0905324B1 on behalf of the Applicant. The Italian patent application no TO2012A000216, also on behalf of the Applicant, and U.S. Pat. No. 6,058,869 also proposed providing the floating bodies with ballast tanks so as to be able to vary their position and thus adapt the level of the free edge thereof to mooring vessels.

In any case, these prior art solutions are not capable of providing an efficient breakwater solution to guarantee an efficient protection against water waves required for a port or shore.

SUMMARY OF THE INVENTION

The object of the present invention is to provide a floating dam or island which, based on the aforementioned prior art floating wharfs, offers a valid alternative to conventional permanent installations, also guaranteeing greater functional efficiency thereof.

A further object of the invention is to allow manufacturing a floating dam or island through a particular inexpensive method.

With the aim of attaining these objects, according to a first aspect the invention regards a method for manufacturing a floating dam or island, characterised in that it comprises the following steps:

- pre-fabricating a plurality of modular hollow bodies having a generally parallelepiped shape and made of ferro-cement or similar materials with longitudinal, transversal and vertical reinforcing rods at least partly projecting outwards,
- laying a first group of said modular bodies to float on a water surface, positioning said modular bodies in mutual side-to-side arrangement so as to delimit therebetween intermediate gaps within which said reinforcing rods are protruding;
- performing a first concrete casting into said gaps and over said modular bodies so as to render them mutually joined through vertical counter-walls and a horizontal slab,
- laying a second group of said modular bodies over said first group and performing a second concrete casting in order to join said first and second group together,
- proceeding likewise by laying additional groups of modular bodies and performing further concrete castings up to obtaining a monolithic block having the desired floating dam or island configuration, wherein the step of laying at least part of said additional groups of modular bodies is preceded by a stage of controlled flooding of the modular bodies beneath.

According to a preferred embodiment, between the side-to-side modular bodies spacer means are provided designed to be embodied within the concrete castings. Such spacer means may be conveniently integrally formed with the modular bodies and they are preferably formed by annular members projecting laterally at intercommunication apertures between the modular bodies.

The modular bodies may also be mutually joined using mechanical coupling and/or gluing means.

The method according to the invention may further comprise the step of providing and fitting submerged dummy-bottom tanks for stabilising the floating dam or island.

At the end of the manufacturing operations, the floating dam or island is anchored to the floor through robust conventional anchoring systems, possibly after being moved to a different anchoring site with respect to where it was manufactured.

Alternatively, particularly in the case of floating islands, the structure may be provided with self-propelling devices to allow geo-positioning thereof within a limited range: devices suitable for this purpose may include thrust compressed air generators, Fletner rotors ("rotating sails"), rotating propellers of the bow-thrusters type, Voith-Schneider propellers and the like.

According to another aspect, the invention regards a floating dam or island manufactured according to the aforementioned method.

Thanks to this solution idea, the floating dam or island according to the invention allows attaining, with respect to the usual conventional permanent structures, a series of important advantages listed below:

- given that it is not permanent, the floating structure is entirely flexible in the sense that the configuration thereof may be easily modified, for example made larger or smaller, depending on the installation needs, the same applying to the positioning thereof which may be easily varied at a low cost,
- the environmental impact of the floating structure with respect to a permanent dam is close to zero: the structure is non-invasive with respect to the environment also due to the fact that it does not entirely block the underwater currents and it can also be removed rapidly if required,
- any design errors regarding the correct positioning are easily avoided and can be rapidly corrected according to the actual conditions tested during the test stage,
- after completing manufacturing thereof, the adjustment of the position of the floating dam or island is performed during the anchoring stage: the ideal position thereof may be easily modified depending on the requirements and the floating dam or island may be possibly moved, by dragging or through self-propelling means, to a different location before being anchored again, thus, the installation is no longer a permanent but a dynamic structure which can be adapted to different future needs even by possibly modifying the composition of the modular hollow bodies of the floating structure, the circulation of the deep waters, allowed by the partial floating of the dam or island, allows constant cleaning of the site, incomparable to any other conventional permanent structure, should the dam be designed to protect a port or shore, the favourable environmental conditions—due to the fact that the waters thereof are rich with oxygen and naturally balanced—make them considerably attractive for the port users: foul odour and stagnation are replaced by transparency and water movement, expenses and construction times are extremely low with respect to the conventional permanent structures, thus leading to reducing the costs of the works and materials, in particular for the construction of ports and coastlines on deep seabeds, where the conventional construction costs are proportional to depth and the ensuing use of lithic materials. The costs of the structure according to the invention are linear given that they solely depend on the number of modules provided for at the plan stage and the meteorological conditions expected in the application site;

the modularity of the hollow bodies not only guarantees low costs and execution times thereof but also the use of simple equipment.

BRIEF DESCRIPTION OF THE DRAWINGS

The invention will now be described in detail, purely by way of non-limiting example, with reference to the attached drawings, wherein.

DETAILED DESCRIPTION OF THE INVENTION

Figure 1:
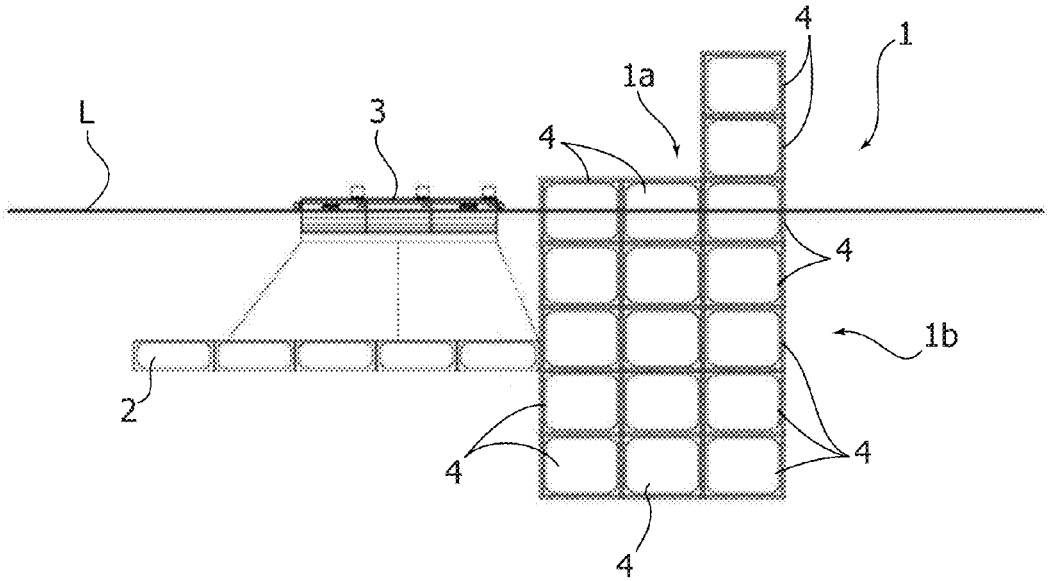
FIG. 1 is a schematic view, in vertical section, of a possible embodiment of a floating dam manufactured using the method according to the invention.

Initially referring to FIG. 1, a portion of a floating breakwater dam manufactured using the method of the invention is indicated in its entirety with 1. Obviously, the represented configuration is purely by way of example, in that the manufacture of the floating dam, in terms of shape and size, may widely vary according to the design parameters thereof. In addition, it may be adapted to the construction of floating dams with various geometric shapes and not only designed for breakwater purposes but also for mooring vessels as well as residential settlements or settlements of other types.

In any case, the floating structure, manufactured according to the method described in detail hereinafter, has an upper part 1*a* projecting above the waterline L on the water surface where the floating dam 1 is installed, and a submerged lower part 1*b*. The submerged part 1*b* shall, for example, be configured and dimensioned as a function of the statistical analysis regarding the predictable wave motion, even in terms of maximum values, regarding the water surface.

In the example represented in FIG. 1, the floating dam 1 may be provided with submerged dummy-bottom tanks 2, with zero hydrostatic pressure, as well as possible floating wharfs 3 anchored to the tanks 2 for mooring vessels. Such floating wharfs 3 may for example be of the type described and illustrated in the previously mentioned European patent EP-0905324 B1 on behalf of the Applicant.

Figure 2:
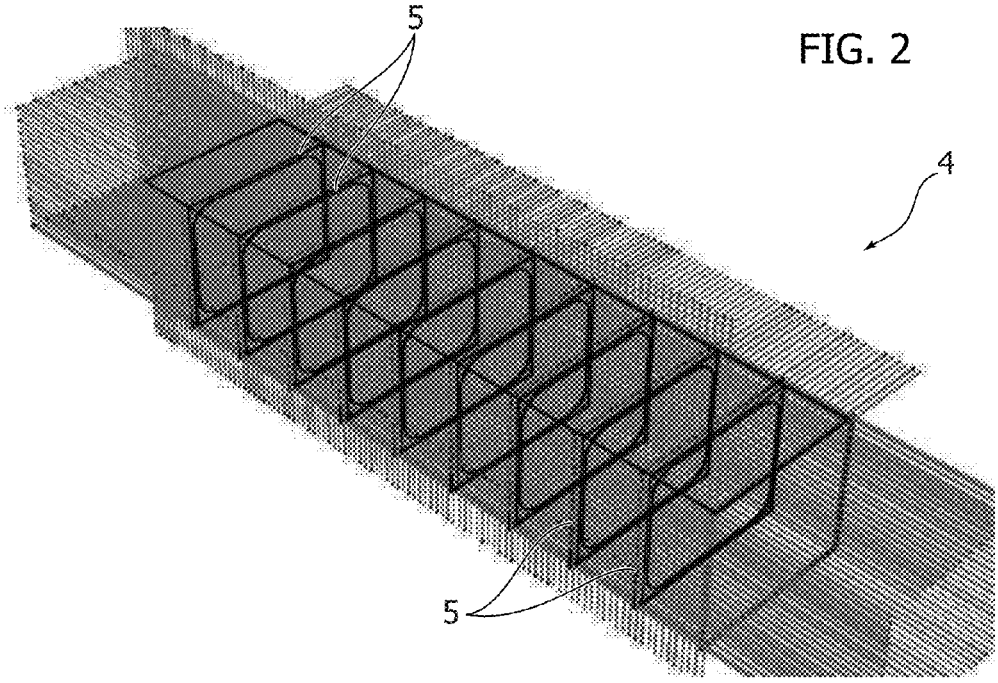
FIG. 2 is an enlarged schematic perspective view showing an embodiment of one of the modular hollow bodies used for manufacturing the floating dam.
Figure 3:
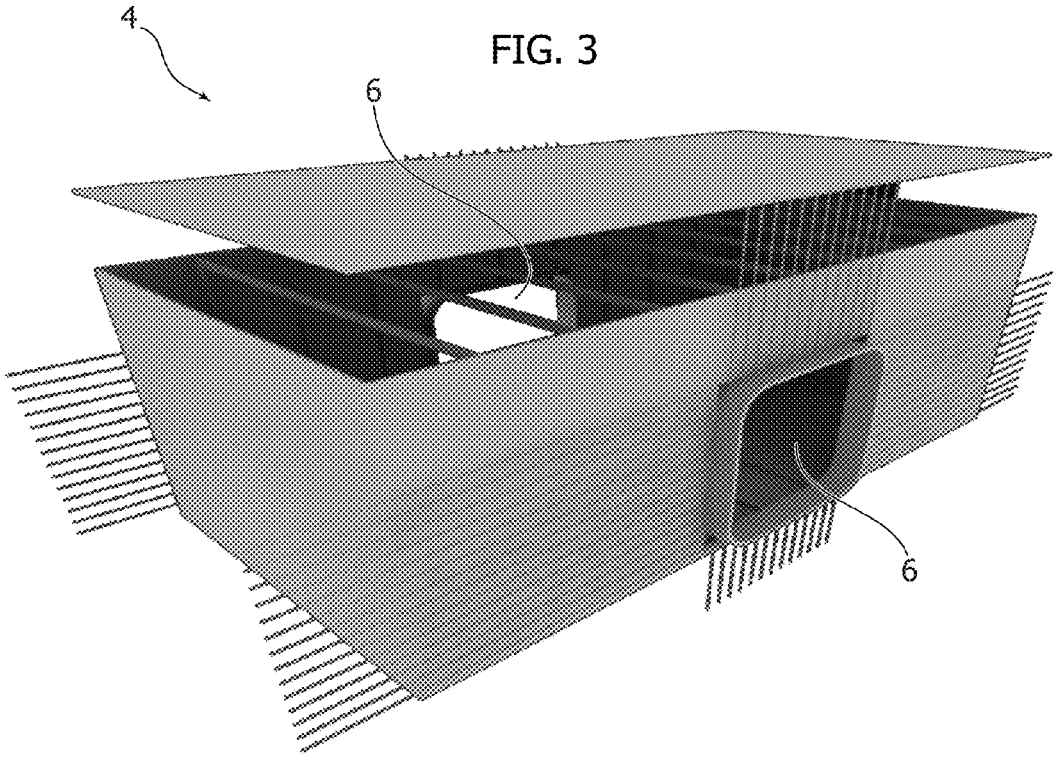
FIGS. 3 and 4 are analogous perspective views of a further embodiment of a modular hollow body used for forming the floating dam.
Figure 4:
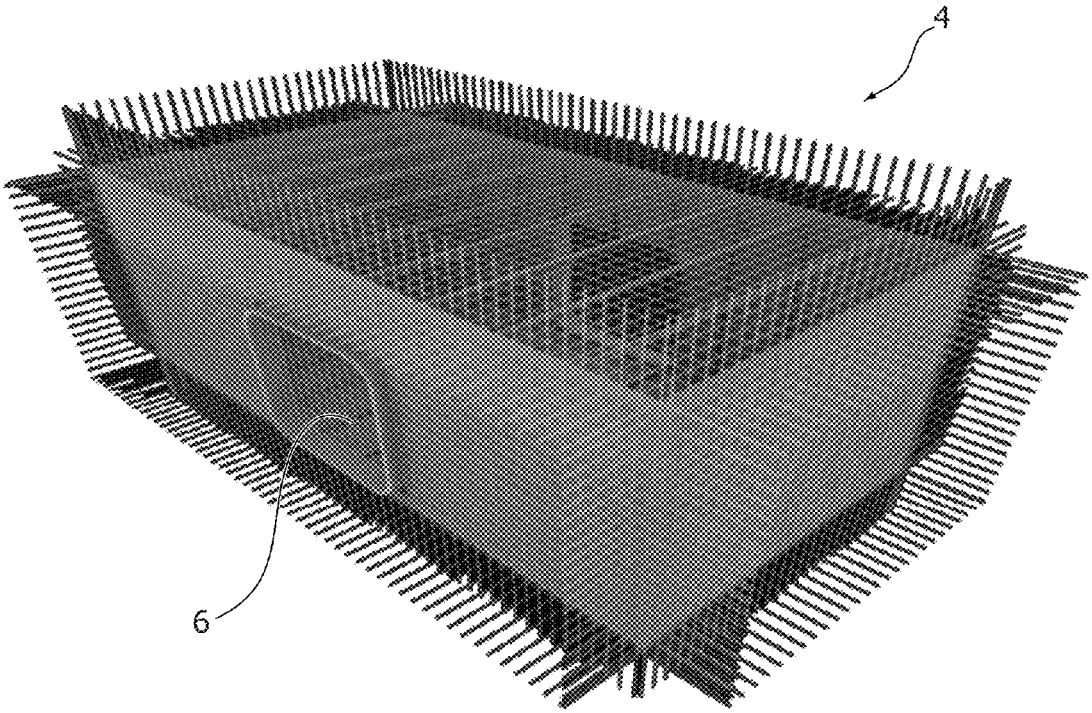
Figure 5:
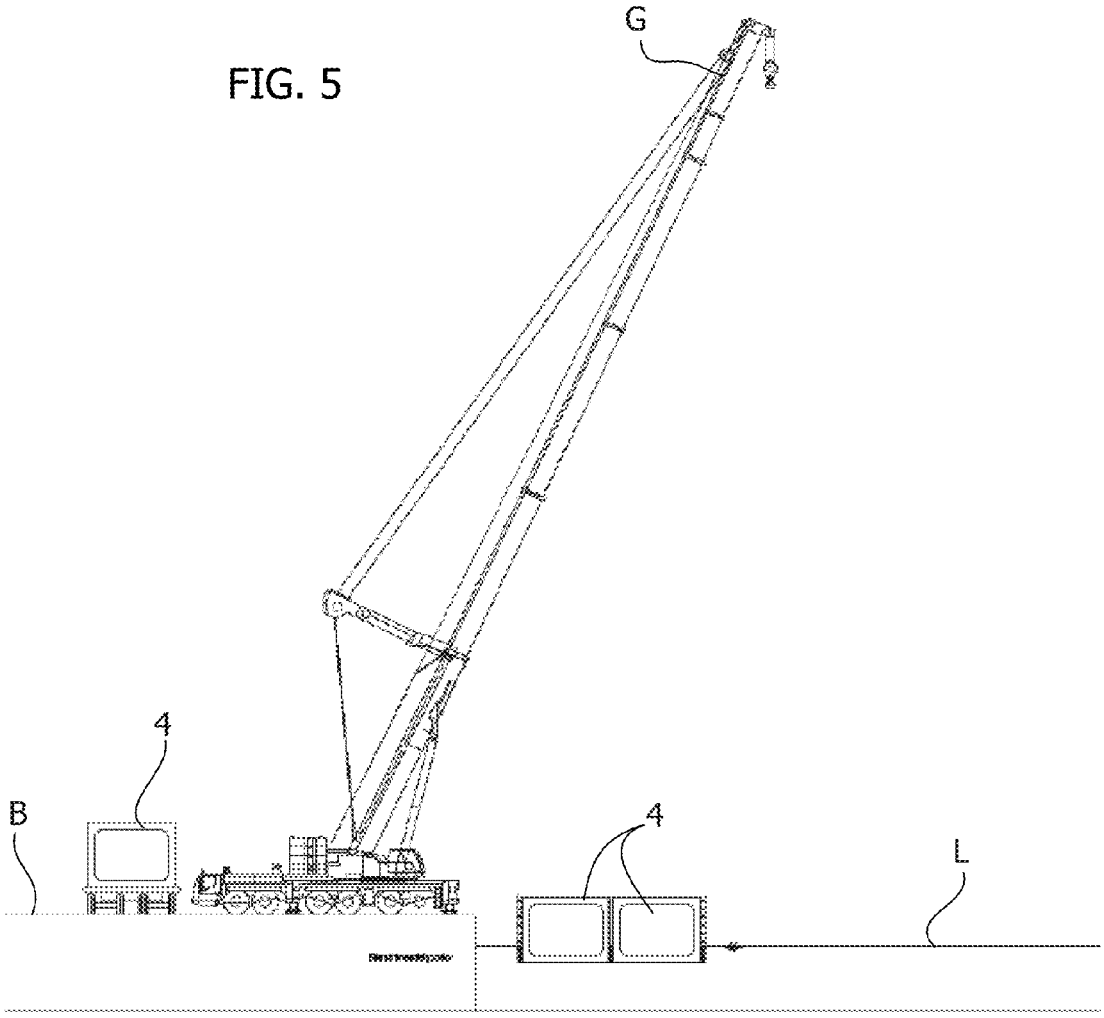
FIGS. 5 to 12 are schematic views representing the succession of the steps for manufacturing the floating dam.
Figure 6:
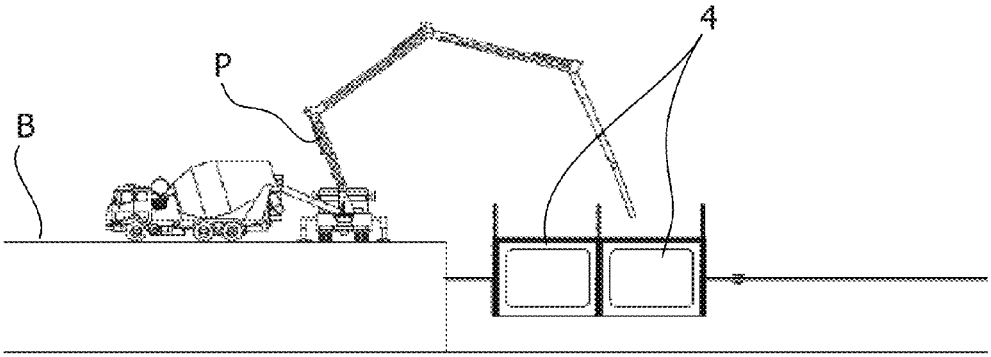
Figure 7:
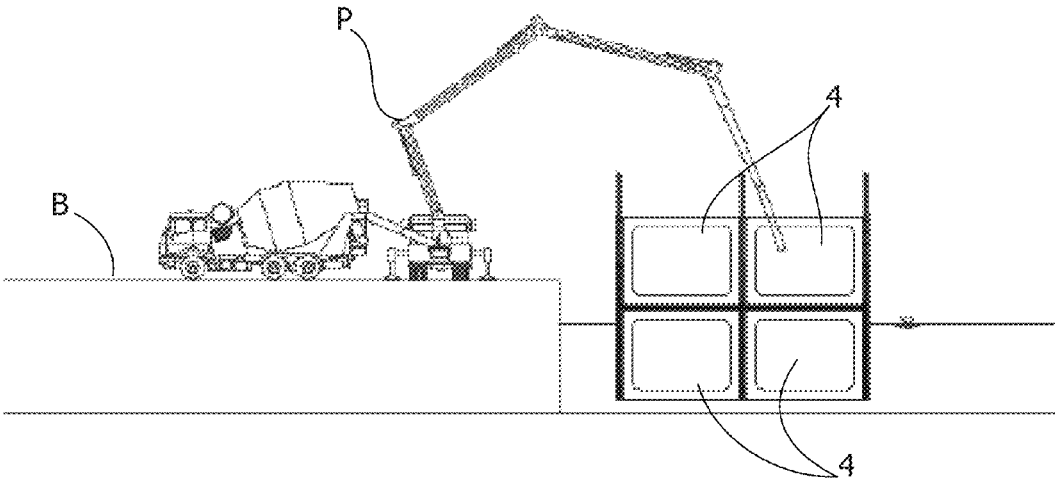

The floating dam 1 is formed by a plurality of modular hollow bodies 4 one of which is schematically represented in FIGS. 2 to 4. Each modular body 4 is formed by a generally parallelepiped-shaped pre-fabricated tank conveniently manufactured using ship building techniques with ferro-cement. Other similar composite materials, in particular ironwood, may also be used.

Typical dimensions may for example be 20 m (length), 5 m (width) and 4 m (height), with a 4 cm wall thickness. Transversal stiffening septa or ribs 5 may be provided for in the module 4 for example with a 1 m pitch, and—as regards the modules 4 designed to be positioned above the waterline L—apertures for access to possible internal service gaps may be provided for.

The required reinforcing rods, even in form of wire mesh, shall be established during the planning stage and thus they are variable in terms of density and thickness and they may be absent for some modular bodies 4 or parts thereof, for example in cases where they can be mechanically joined with contiguous modular bodies 4, through pins or rods, and/or by gluing.

FIG. 2, shows the arrangement of the longitudinal, transversal and vertical reinforcing rods of each module 4, at least partly projecting outwards for joining with the contiguous modules 4 by means of the methods outlined hereinafter.

FIGS. 3 and 4 show an exemplary preferred embodiment of the modular body 4 which is provided, at at least one of the walls thereof, with an annular spacer member 6 projecting outwards for reasons to be outlined hereinafter. The annular spacer member 6 also allows providing an intercommunication passage between the module 4 and the contiguous module/s 4 after composition thereof The methods for manufacturing the floating dam 1 are exemplified in succession in FIGS. 5-12, described hereinafter. As clarified previously, the modular hollow bodies 4 are pre-fabricated and thus moved to a quay B one at a time so as to be lifted, by means of a crane G, and transferred to the water surface.

Figure 8:
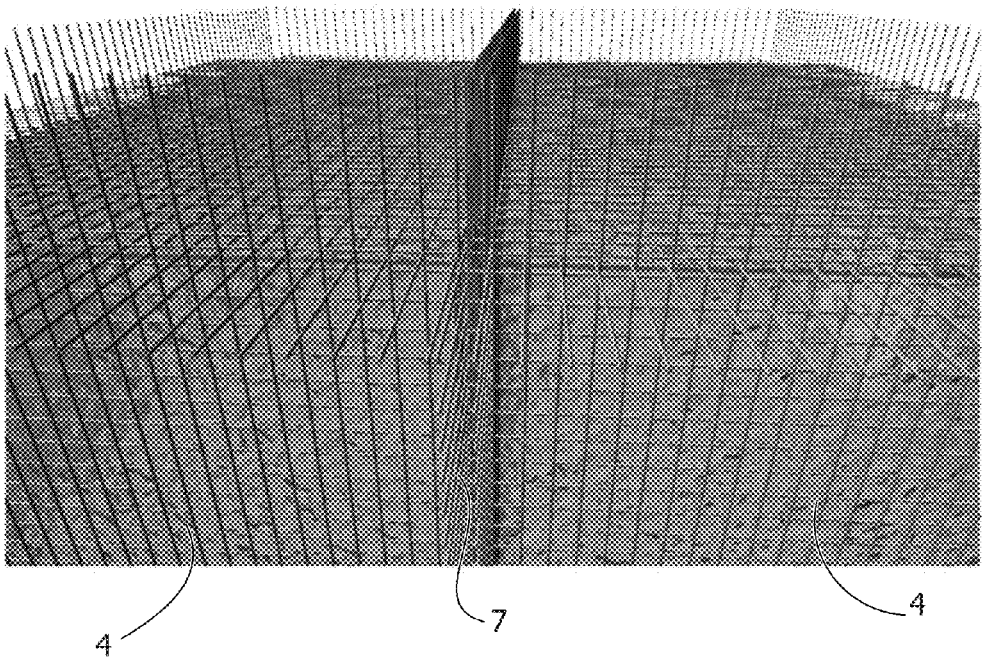
Figure 9:
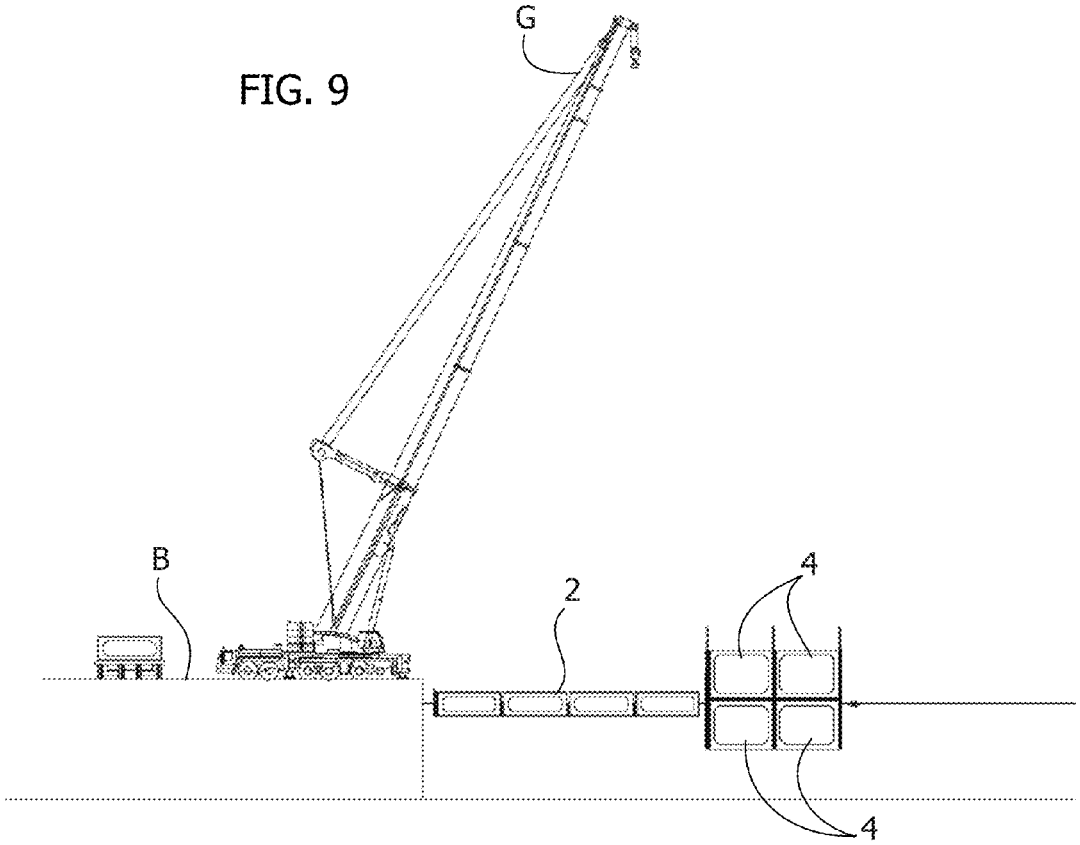
Figure 10:
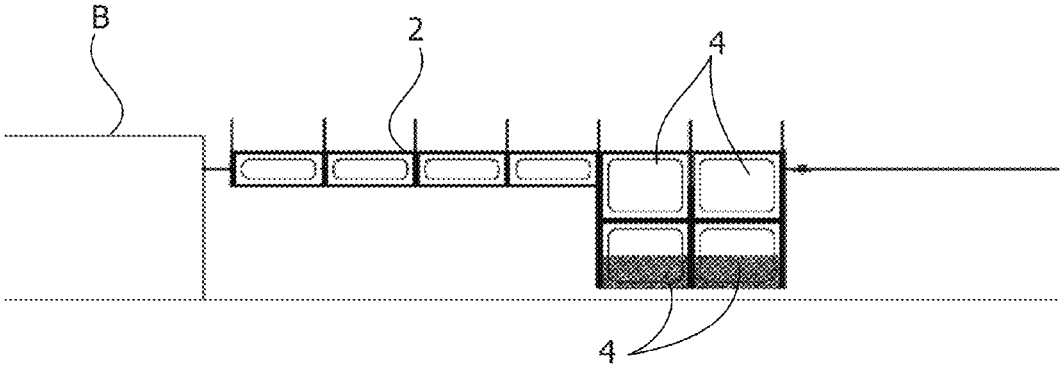
Figure 11:
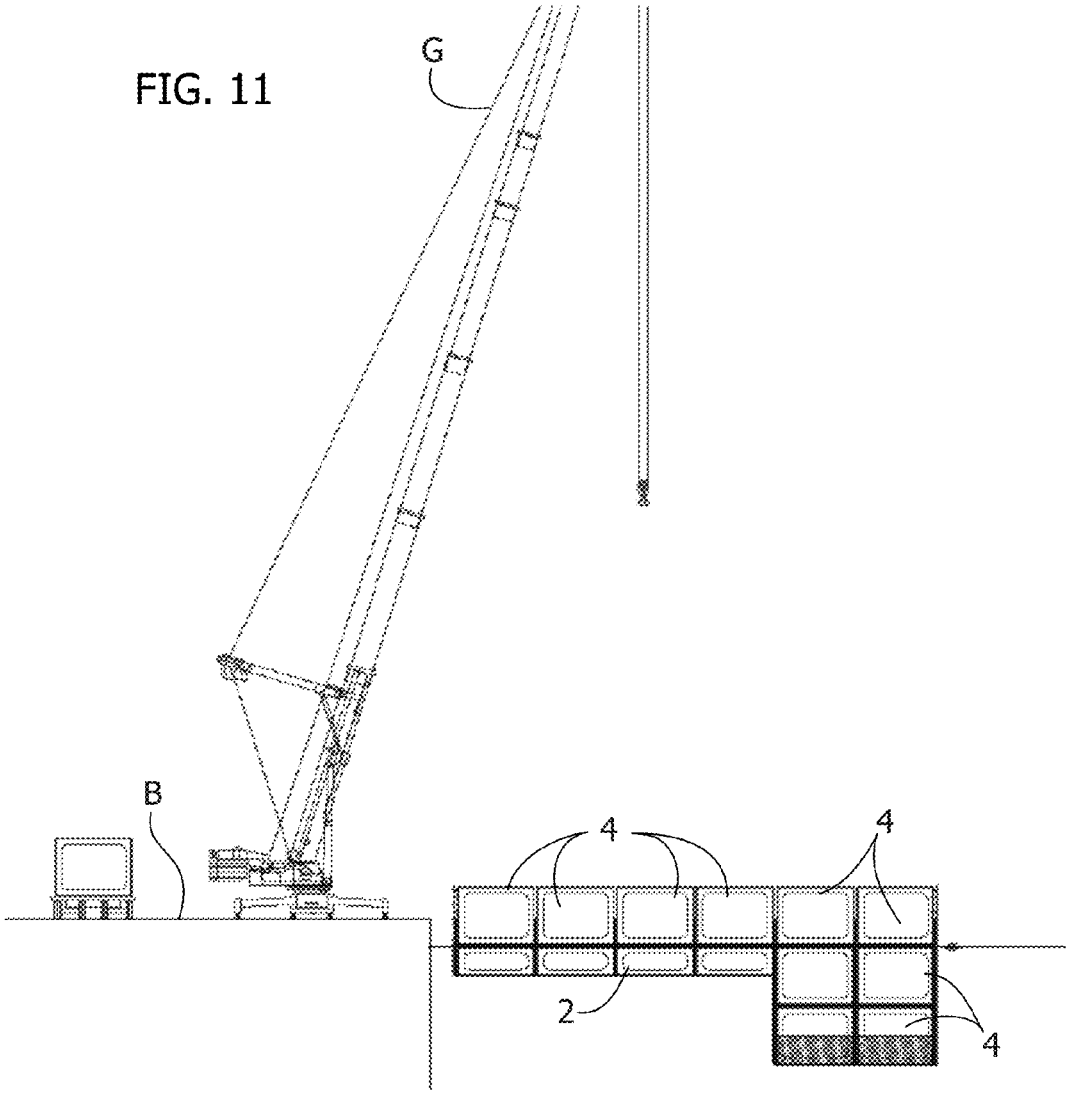

The first step (FIG. 5) consists of laying a first group of said modular bodies 4 to float near the quay B in mutual side-to-side arrangement so as to delimit therebetween intermediate gaps within which the respective longitudinal and transversal reinforcing rods are protruding as schematically illustrated in FIG. 8, in which one of such gaps is indicated with 7. Such gap 7 is for example defined by the coupling of the spacer members 6 of the modules 4, illustrated in FIGS. 3 and 4, also serving as positioning members. These spacer/positioning members 6 may define intercommunication passages or wire and pipe passages between the contiguous modular bodies 4, and they may be of various and several types, with different shapes depending on the planning requirements.

In the subsequent step (FIG. 6), the modules 4 of the first group are mutually joined through a first concrete casting, by means of a first concrete mixer pump truck P, so as to obtain vertical counter-walls which embody spacer members 6, and an upper horizontal slab. As regards the casting, a particularly fluid but quick drying concrete is used. In addition, possible conventional formworks or formworks made of ferro-cement panels or other material, serving as disposable formworks are used.

The subsequent step (FIG. 7) consists of laying a second group of modular bodies 4 on the first group and performing a second concrete casting in order to join the first and second group together.

Possible dummy-bottom tanks 2 (FIG. 9), to be subsequently joined to the floating dam 1 for a better stabilisation thereof as well as for obtaining a more efficient reduction of the wave motion, are then laid.

Figure 12:
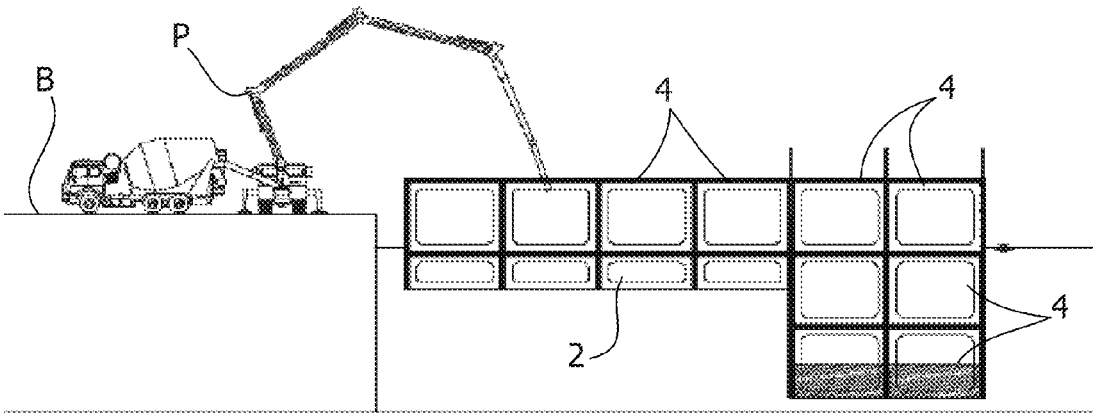

The subsequent step (FIG. 10) consists of a controlled flooding of at least part of the first group of modular bodies 4 so as to lower the second group and then proceeding to lay a third group of modular bodies 4 (FIG. 11), which are then joined to the second group through a further concrete casting (FIG. 12). The controlled flooding stage may for example be obtained through the methods described in the aforementioned Italian patent no TO2012A000216, or other systems known to a man skilled in the art.

Then, there follows an analogous process, selectively flooding—if necessary—at least part of the modules 4 up to the complete formation of the floating dam 1 according to the designed configuration.

Figure 13:
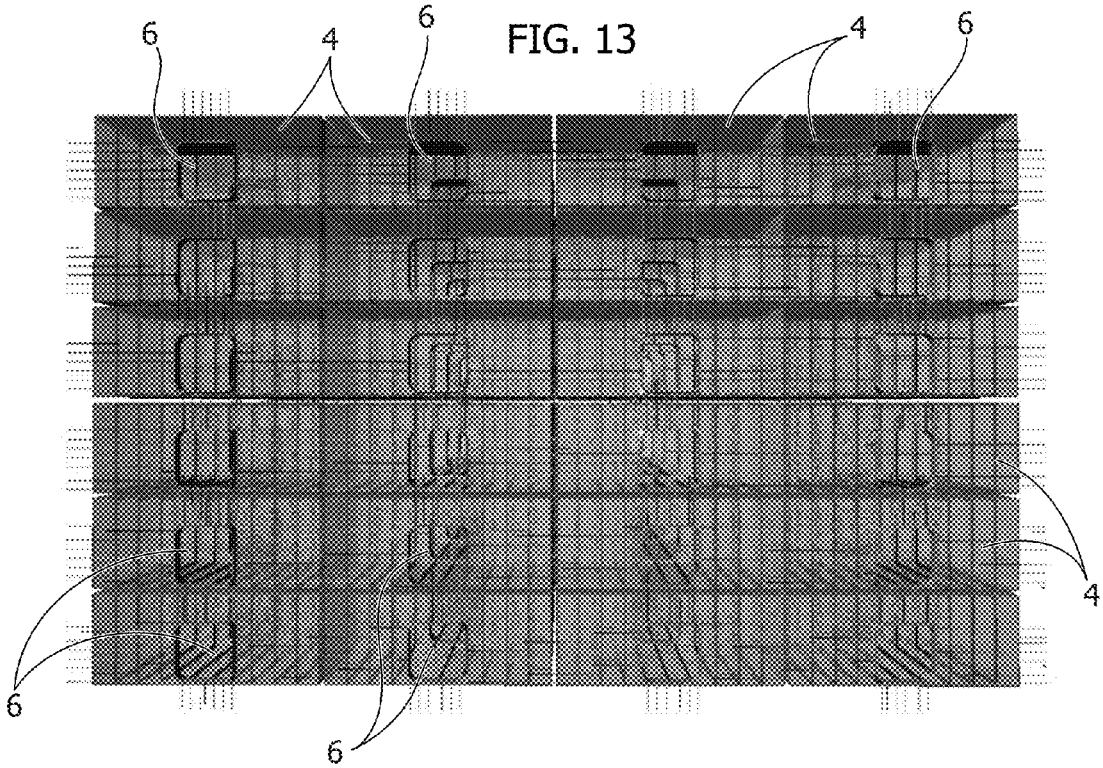
FIG. 13 is a schematic front elevational view of a part of the floating dam in a step of the manufacturing method thereof.
Figure 14:
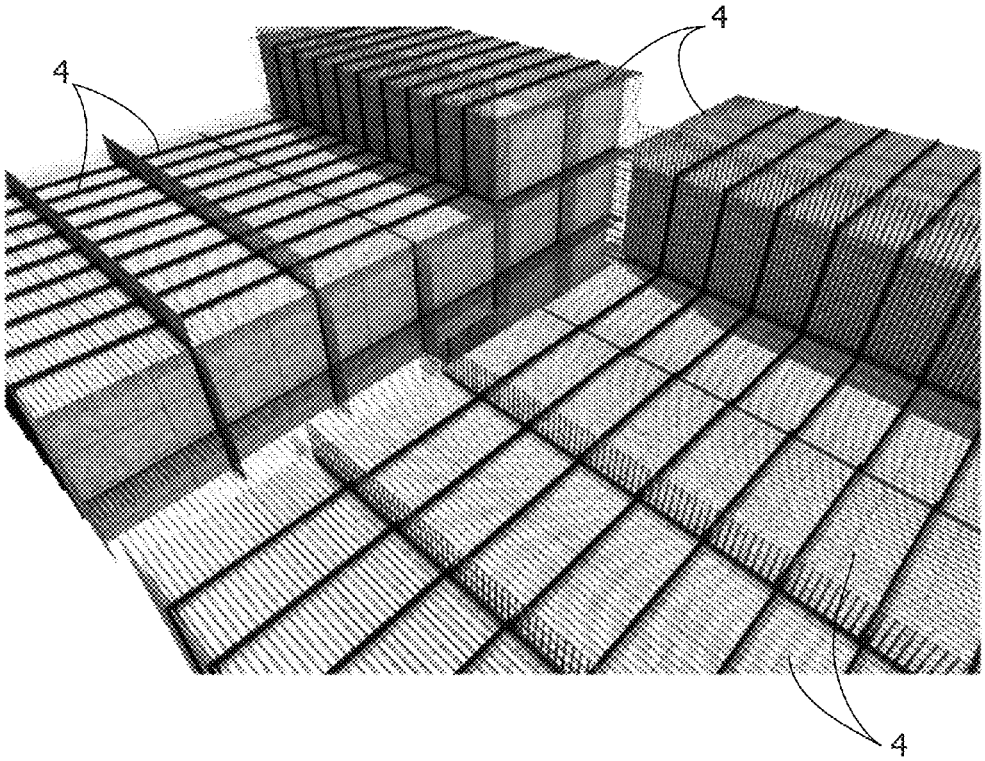
FIG. 14 is a perspective view of FIG. 13.

FIGS. 13 and 14 schematically show possible examples of configurations of the various groups of modular bodies 4 with the respective reinforcing rods and the relative spacer members 6.

Figure 15:
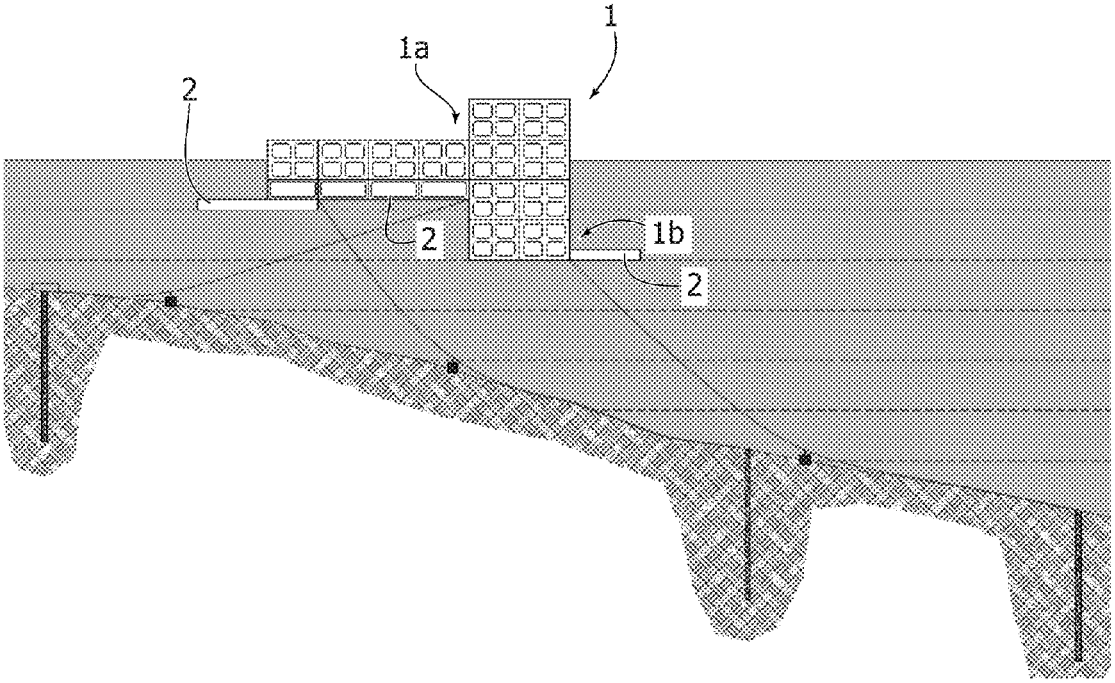
FIG. 15 is an elevational schematic view showing an example for anchoring the floating dam at the end of the manufacturing thereof.

At the end, the floating dam 1 is dragged to the site it is meant to be positioned and then it is anchored to the floor by means of conventional systems with piles and chains, as schematically illustrated in FIG. 15.

Figure 16:
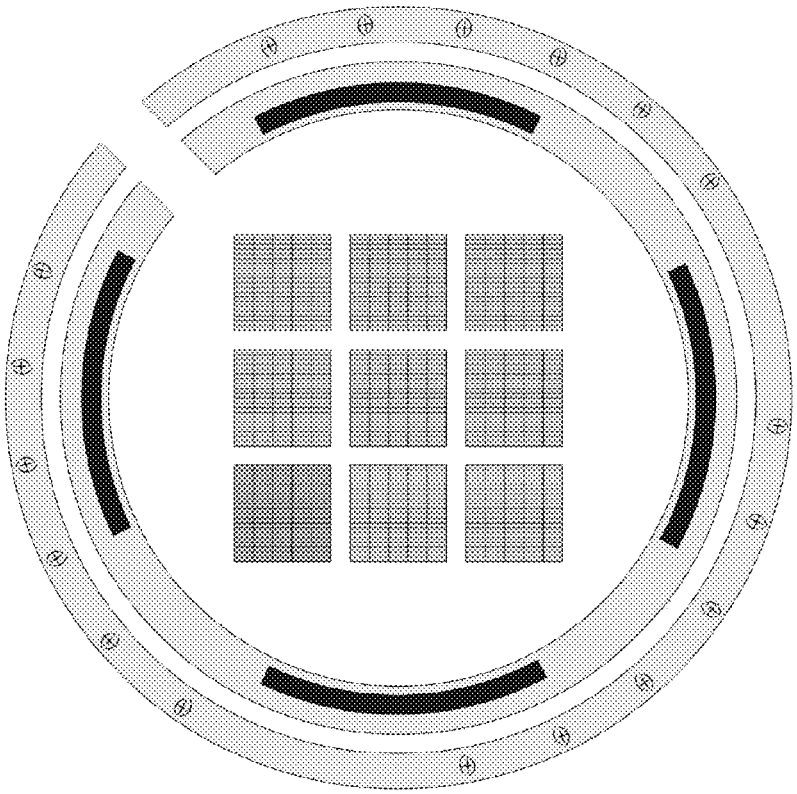
FIGS. 16 and 17 are top plan schematic views showing examples of two types of floating islands manufactured according to the invention.
Figure 17:
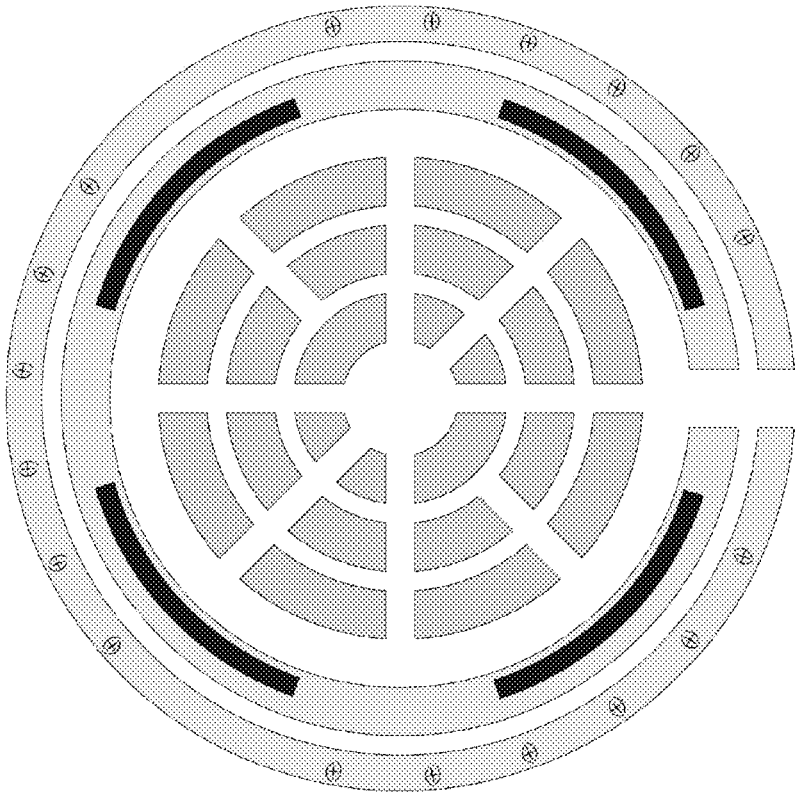

FIGS. 16 and 17 show two examples of possible planimetric configurations of a composite floating island manufactured according to the invention, in which two concentric circular dams are provided to protect a group of residential, commercial and service floating modules. The circular dams shall be provided with wind and/or photovoltaic and/or turbine wells systems for generating electricity, as well as water purification plants and other service equipment.

From the description above, it is clearly evincible that the floating dam or island according to the invention allows attaining several advantages with respect to conventional solutions with permanent structure obtained by means of conventional construction techniques: Besides the aforementioned advantages, lying in the fact that the structure is simple and inexpensive to construct, easy to move or remove as well as its low environmental impact, another advantage lies in the fact that the configuration of the modular hollow bodies that form the structure allows the construction thereof in industrial plants with elementary equipment, and the subsequent transfer to the site of installation by means of entirely ordinary means, thus further reducing the environmental impact.

Obviously, the construction details and the embodiments may widely vary with respect to what has been described and illustrated, without departing from the scope of protection of the present invention as described in the claims that follow. Thus, as previously mentioned, contiguous modular hollow bodies 4 may also be mutually joined by means of mechanical systems and/or gluing.

The invention claimed is:

1. A method for constructing a floating dam or island, comprising:

pre-fabricating a plurality of modular hollow bodies having a parallelepiped shape and made of ferro-cement or similar materials with longitudinal, transversal and vertical reinforcing rods at least in part projecting outwards, laying a first group of said modular bodies to float on a water surface, positioning said modular bodies in mutual side-to-side arrangement so as to delimit therebetween intermediate gaps within which said reinforcing rods are protruding;

performing a first concrete casting into said gaps and over said modular bodies so as to render them mutually joined through vertical counter-walls and a horizontal slab, laying a second group of said modular bodies over said first group and performing a second concrete casting in order to join said first and second group together, laying additional groups of modular bodies and performing further concrete castings to obtain a monolithic block having a desired floating dam or island configuration, wherein the step of laying at least part of said additional groups of modular bodies is preceded by a controlled flooding of the modular bodies beneath the additional groups being laid.

2. The method according to claim 1, wherein said side-to-side modular bodies are provided with a spacer means embodied within the concrete castings.

3. The method according to claim 2, wherein said spacer means are integrally formed with said modular bodies.

4. The method according to claim 2, wherein said modular bodies are formed with inner strengthening ribs.

5. The method according to claim 2, further comprising providing and fitting submerged dummy-bottom tanks for stabilising the floating dam or island.

6. The method according to claim 2, further comprising providing permanent anchorages of said floating dam or island.

7. The method according to claim 2, further comprising providing floating wharfs connected to said floating dam or island.

8. A floating dam or island manufactured according to claim 2.

9. The method according to claim 3, wherein said spacer means consist of annular members projecting from the lateral walls of said modular bodies at respective intercommunication apertures.

10. The method according to claim 3, wherein said modular bodies are formed with inner strengthening ribs.

11. The method according to claim 3, further comprising providing and fitting submerged dummy-bottom tanks for stabilising the floating dam or island.

12. The method according to claim 3, further comprising providing permanent anchorages of said floating dam or island.

13. The method according to claim 3, further comprising providing floating wharfs connected to said floating dam or island.

14. The method according to claim 9, wherein said modular bodies are formed with inner strengthening ribs.

15. The method according to claim 9, further comprising providing permanent anchorages of said floating dam or island.

16. The method according to claim 1, wherein said modular bodies are formed with inner strengthening ribs.

17. The method according to claim 1, further comprising providing and fitting submerged dummy-bottom tanks for stabilising the floating dam or island.

18. The method according to claim 1, further comprising providing permanent anchorages of said floating dam or island.

19. The method according to claim 1, further comprising providing floating wharfs connected to said floating dam or island.

20. A floating dam or island manufactured according to claim 1.

* * * * *